US005434036A

United States Patent [19]

Texter

[11] Patent Number: 5,434,036

[45] Date of Patent: Jul. 18, 1995

[54] PROCESS FOR FORMING MICROCRYSTALLINE COUPLER DISPERSIONS

[75] Inventor: John Texter, Rochester, N.Y.

[73] Assignee: Eastman Kodak Company, Rochester, N.Y.

[21] Appl. No.: 247,180

[22] Filed: May 20, 1994

Related U.S. Application Data

[62] Division of Ser. No. 956,140, Oct. 5, 1992, Pat. No. 5,401,623.

[51] Int. Cl.[6] ..... G03C 5/18; G03C 5/26

[52] U.S. Cl. ..... 430/449; 430/377; 430/546; 430/631; 430/935

[58] Field of Search ..... 430/449, 377, 546, 631, 430/935

[56] References Cited

U.S. PATENT DOCUMENTS

| | | | |
|---|---|---|---|
| 2,870,012 | 1/1959 | Godowsky et al. | 430/546 |
| 3,676,147 | 7/1972 | Boyer et al. | 430/569 |
| 4,006,025 | 2/1977 | Swank et al. | 430/567 |
| 4,385,110 | 5/1983 | Yoneyama et al. | 430/377 |
| 4,419,441 | 12/1983 | Nihel et al. | 430/377 |
| 4,474,872 | 10/1984 | Onishi et al. | 430/512 |
| 4,490,461 | 12/1984 | Webb et al. | 430/510 |
| 4,927,744 | 5/1990 | Henzel et al. | 430/566 |
| 4,948,718 | 8/1990 | Factor et al. | 430/522 |
| 4,970,139 | 11/1990 | Bagchi | 430/449 |
| 5,008,179 | 4/1991 | Chari et al. | 430/546 |
| 5,089,380 | 2/1992 | Bagchi | 430/449 |
| 5,110,717 | 5/1992 | Czekai et al. | 430/512 |

FOREIGN PATENT DOCUMENTS

| | | |
|---|---|---|
| 1105761 | 7/1981 | Canada . |
| 0138831 | 11/1979 | Germany . |
| 0139040 | 12/1979 | Germany . |
| 1193349 | 5/1970 | United Kingdom . |
| 1570362 | 7/1980 | United Kingdom . |

*Primary Examiner*—Charles L. Bowers, Jr.
*Assistant Examiner*—Geraldine Letscher
*Attorney, Agent, or Firm*—Paul A. Leipold

[57] ABSTRACT

Process for forming a microcrystalline coupler dispersion comprising the steps of: providing crystalline coupler in an aqueous suspension; dispersing said coupler with mechanical shear, combining said coupler dispersion with an activating water-immiscible organic solvent; and mixing said combined dispersion is disclosed.

18 Claims, 13 Drawing Sheets

PROCESS FOR FORMING MICROCRYSTALLINE COUPLER DISPERSIONS

This is a Divisional of application Ser. No. 956,140 filed Oct. 5, 1992, U.S. Pat. No. 5,401,623.

FIELD OF THE INVENTION

This invention relates to photographic systems and processes for forming image dye in light sensitive silver halide emulsion layers and to the nature of the photographically active coupler dispersions used to form said dye image. More particularly this invention relates to the composition and morphology of said coupler dispersions, the physical state of coupler in said dispersions, and the reactive association of said coupler molecules with activating water-immiscible organic solvents.

BACKGROUND OF THE INVENTION

Godowsky and Duane, in U.S. Pat. No. 2,870,012, disclose a solvent-shifting process for preparing microdispersions of color coupler compounds comprising at least one acid group (carboxyl or sulfonic acid).

Townsley and Trunley, in U.K. Pat. No. 1,193,349, disclose a solvent-shifting and pH-shifting process in the presence of a protective colloid for dispersing couplers as amorphous colloidal dispersions. Their process is applied to couplers that have no sulphonic acid or carboxylic acid solubilizing groups and that are soluble in a mixture of water-miscible organic solvent and aqueous alkali.

Webb et at. in U.S. Pat. No. 4,490,461, disclose a process for the preparation of a photographic material comprising at least one silver halide emulsion layer and which contains in at least one layer a photographically useful compound selected from the group consisting of developing agents, color couplers, optical brighteners, filter dyes, or acutance dyes. Said process comprises forming a solution of a photographically useful compound, a compound capable of being cross-linked, and a cross-linking agent for the cross-linkable compound, effecting cross-linking of the cross-linkable compound to form a cross-linked solid, isolating the solid and milling the solid to form particles of 0.1–0.5 μm in size, dispersing the particles in a colloid binder coating solution, coating this solution on a photobase and drying the layer.

Bagchi, in U.S. Pat. Nos. 4,970,139 and 5,089,380, discloses methods of preparing precipitated coupler dispersion with increased photographic activity. Said methods comprise steps to simultaneously precipitate hydrophobic couplers in the form of small particles and wherein said particles incorporate at their instant of formation water-insoluble coupler solvents.

Chari et al., in U.S. Pat. No. 5,008,179, disclose the preparation of amorphous coupler dispersions by pH and solvent shifting and the mixing of said coupler dispersions with dispersions of permanent solvent immediately prior to preparing light sensitive coating melts. This process of combining permanent solvent with amorphous coupler dispersion minimizes certain difficulties arising from crystallization of said coupler during storage of the coupler dispersion. Chari et al. disclose the preparation of permanent solvent dispersions wherein the permanent solvent is loaded into a polymeric latex.

Langen et al., in U.K. Pat. No. 1,570,362 disclose the use of solid particle milling methods such as sand milling, bead milling, dyno milling, and related media, ball, and roller milling methods for the production of solid particle dispersions of photographic additives such as couplers, UV-absorbers, UV stabilizers, white toners, stabilizers, and sensitizing dyes.

Henzel and Zengerle, in U.S. Pat. No. 4,927,744, disclose photographic elements comprising solid particle dispersions of oxidized developer scavengers. Said dispersions are prepared by precipitation and by milling techniques such as ball-milling.

Boyer and Caridi, in U.S. Pat. No. 3,676,147, disclose a method of ball-milling sensitizing dyes in organic liquids as a means of spectrally sensitizing silver halide emulsions. Langen et al., in Canadian Patent No. 1,105,761, disclose the use of solid particle milling methods and processes for the introduction of sensitizing dyes and stabilizers in aqueous silver salt emulsions. Swank and Waack, in U.S. Pat. No. 4,006,025, disclose a process for dispersing sensitizing dyes, wherein said process comprises the steps of mixing the dye particles with water to form a slurry and then milling said slurry at an elevated temperature in the presence of a surfactant to form finely divided particles. Onishi et al., in U.S. Pat. No. 4,474,872, disclose a mechanical grinding method for dispersing certain sensitizing dyes in water without the aid of a dispersing agent or wetting agent. This method relies on pH control in the range of 6–9 and temperature control in the range of 60°–80° C.

Factor and Diehl, in U.S. Pat. No. 4,948,718, disclose solid particle dispersions of dyes for use as filter dyes in photographic elements. They disclose that such dyes can be dispersed as solid particle dispersions by precipitating or reprecipitating (solvent or pH shifting), by ball-milling, by sand-milling, or by colloid-milling in the presence of a dispersing agent.

PROBLEM TO BE SOLVED BY THE INVENTION

The crystallization of couplers in amorphous coupler dispersions during storage, during the preparation of photographic elements, and during the storage of photographic elements is a well known deleterious result of the metastability of amorphous coupler dispersions. Such crystallization usually leads to crystallites in excess of 10 μm in largest dimension. Said crystallites cause unwanted scattering of light in photographic elements and loss of gloss, result in substantially decreased specific surface area and decreased effective coupling activity in development processes, and cause gelation of melts and clogging of filters in the coating of photographic elements.

It is known that the preparation of dispersions of couplers and dyes by pH-shifting and by solvent-shifting generally results in said couplers and dyes being in an amorphous physical state, rather than in a crystalline state. Such dispersions are metastable and prone to subsequent crystallization during storage.

Processes utilizing solvent-shifting require the removal of water-miscible solvents subsequent to formation of the dispersion. Such methods for water-miscible solvent removal include evaporation, distillation, and washing. Before and during such solvent removal, the coupler dispersion particles, generally in a metastable thermodynamic state, are prone to ripening and crystallization into large crystallites. Moreover, the utilization of such water-miscible solvents is an unwanted expense.

While it is known that couplers can be dispersed as solid particle dispersions, the practical commercialization of dispersing couplers in photographic film and paper elements has not come to significant fruition because such dispersions of couplers are generally not reactive enough to provide sufficient image dye densities. In particular, solid particle dispersions of microcrystalline couplers are particularly inactive in color development solutions when said couplers lack significant solubilization such as imparted by sulfonic acid or carboxyl groups.

It is known that very small-particle, amorphous, and aqueous dispersions of color couplers, as prepared by pH or solvent-shifting, can be combined with aqueous dispersions of permanent solvent to yield improved activity. Said solvent dispersions require a separate process for their formation, whether they are prepared as oil-in-water emulsions or as solvent-loaded latex dispersions. Such separate preparations incur the added cost of surfactant and other dispersing aids, and in many cases the additional cost of said latex. Additional and unwanted costs are incurred in the storage of permanent solvent dispersions.

These and other problems may be overcome by the practice of our invention.

SUMMARY OF THE INVENTION

An object of this invention is to provide microcrystalline coupler dispersions with greatly reduced propensity to ripen into coupler crystallites that clog filters and cause unwanted light scattering effects in coated photographic elements. Another object of this invention is to provide microcrystalline coupler dispersions that eliminate the need for water-miscible solvent removal subsequent to particle formation.

A further object of this invention is to greatly reduce the need to prepare permanent solvent dispersions and the costs associated with preparing and storing such dispersions.

These and other objects of the invention are generally accomplished by providing a process for forming a microcrystalline coupler dispersion comprising the steps of: providing crystalline coupler in an aqueous suspension; dispersing said coupler with mechanical shear; combining said coupler dispersion with an activating water-immiscible organic solvent; and mixing said combined dispersion.

ADVANTAGEOUS EFFECT OF THE INVENTION

Figure 1:
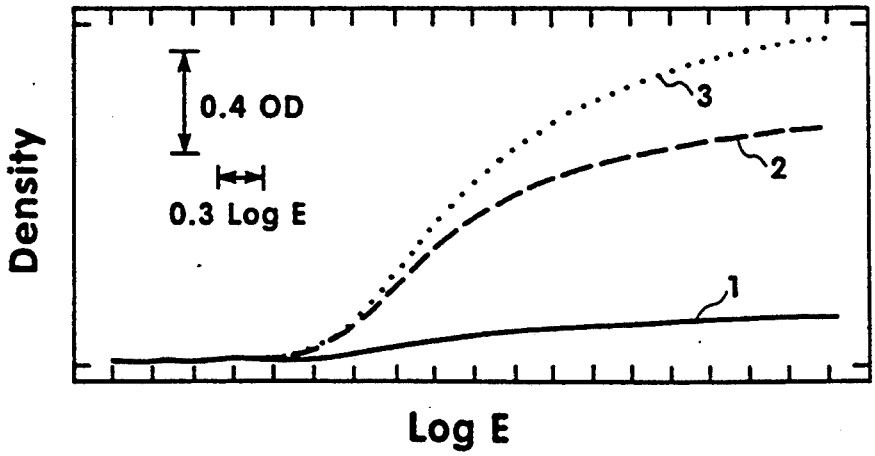
FIG. 1. Sensitometry for coatings of coupler C1, without (curve 1) and with S2 (1:0.25, curve 2; 1:0.5, curve 3), processed in developer A.

The microcrystalline coupler dispersions of the present invention greatly reduce the propensity for coupler ripening into large crystallites greater than about 10 μm in average dimension that clog filters, form interconnected gel structures and networks, and cause unwanted light scattering effects in coated photographic elements. The microcrystalline coupler dispersions of the invention provide improved control of reactivity with respect to image dye formation and largely eliminate dispersion reactivity variability due to uncontrolled coupler crystallization. The present invention provides a simple process for combining microcrystalline coupler dispersions with water-immiscible permanent solvents. This simplicity reduces the need to prepare permanent solvent dispersions and the costs associated with preparing and storing such solvent dispersions.

DETAILED DESCRIPTION OF THE INVENTION

The couplers suitable for this invention may be any couplers that can be dispersed as solid particle microcrystalline dispersions in an aqueous medium. Said couplers are substantially water insoluble at the pH and temperatures of dispersion preparation and use. Typical of such compounds are most photographic color couplers, including those which contain ionizing groups of moderate $pK_a$ such as carboxyl groups and sulfonamido groups.

The term microcrystalline means that long range order among the coupler molecules exists in the dispersion particles such that a sufficient number of such particles in a scattering-volume element will provide a conventional-looking powder diffraction pattern and d-spacings characteristic of small crystalline particles. Such scattering and diffraction criteria are explained and illustrated by H. P. Klug and L. E. Alexander in *X-ray Diffraction Procedures* (John Wiley & Sons, New York, 1974). Couplers are usually obtained in powdered crystalline form as a natural course of their synthesis and purification. In cases where couplers are obtained in an amorphous form, crystallization can be induced by methods well known in the art, such as thermal annealing, seed crystallization, crystallization from alternative solvents, etc. The expression microcrystalline particles means that said particles are in a physical state as described above in the definition of microcrystalline, and further that said particles are smaller than 5 μm in average dimension.

Typical couplers which form cyan dyes upon reaction with oxidized color developing agents are described in such representative patents as U.S. Pat. Nos. 2,313,586, 2,367,531, 2,369,929, 2,423,730, 2,474,293, 2,772,162, 2,801,171, 2,895,826, 3,002,836, 3,034,892, 3,041,236, 3,419,390, 3,476,563, 3,476,565, 3,772,002, 3,779,763, 3,996,252, 4,124,396, 4,248,962, 4,254,212, 4,282,312, 4,296,199, 4,296,200, 4,327,173, 4,333,999, 4,334,011, 4,427,767, 4,430,423, 4,443,536, 4,444,872, 4,451,559, 4,457,559, 4,500,635, 4,511,647, 4,518,687, 4,526,864, 4,557,999, 4,564,586, 4,565,777, 4,579,813, 4,613,564, 4,690,889, 4,775,6 16, and 4,874,689, in Canadian Patent No. 625,822, in European Patent Application No. 0 283 938 A 1, and in European Patent No. 067 689B1, the disclosures of which are incorporated by reference. Suitable couplers that form cyan dyes upon reaction with oxidized color developing agents are of the phenol type and the naphthol type. Typical couplers which form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,311,476, 3,419,391, 3,519,429, 3,615,506, 3,725,067, 3,935,015, 3,936,015, 4,119,361, 4,120,723, 4,351,897, 4,385,111, 4,413,054, 4,443,536, 4,500,630, 4,522,916, 4,540,654, 4,581,326, 4,774,172, 4,853,319, and 4,874,689, Japanese Published Patent Application No. 60/170,854, European Patent Publication Nos. 0 170 164, 0 177 765, 0 240 852 A1, 0 283 938 A1, 0 284 239 A1, 0 284 240 A1, and 0 316 955 A3, and *Research Disclosures* 24220 (June 1984) and 24230 (June 1984), the disclosures of which are incorporated by reference. Suitable couplers that form magenta dyes include pyrazolone, pyrazolotriazole, and pyrazolobenzimidazole compounds. Typical couplers which form yellow dyes upon reaction with oxidized color developing agent are described in such representative U.S. Pat. Nos. as 2,298,443, 2,875,057, 2,407,210, 2,875,057, 3,265,506, 3,384,657, 3,408,194, 3,415,652, 3,447,928, 3,542,840, 3,894,875, 3,933,501, 4,022,620, 4,046,575, 4,095,983 4,133,958, 4,182,630, 4,203,768, 4,221,860, 4,326,024, 4,401,752, 4,443,536, 4,529,691, 4,587,205, 4,587,207 and 4,617,256, 4,622,287, 4,623,616, and in European Patent Applications 0 259 864 A2, 793 A1, 0 283 938 A1, and 0 316 955 A3, the disclosures of which are incorporated by reference. Suitable yellow dye image forming couplers are acylacetamides, such as benzoylacetanilides and pivaloylacetanilides.

Examples of suitable cyan dye-forming couplers include the following:

C1

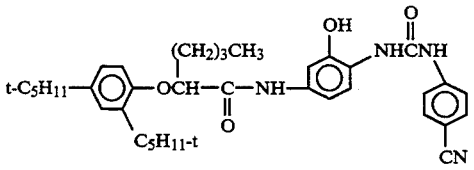

C2

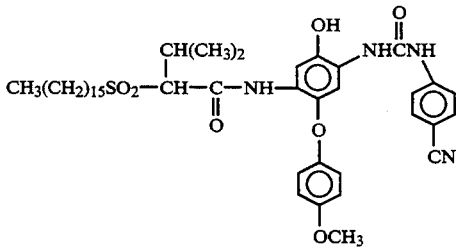

C3

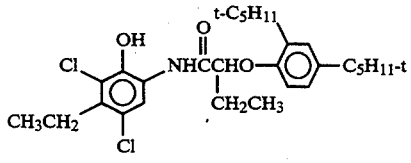

-continued

C4

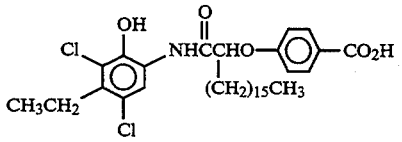

C5

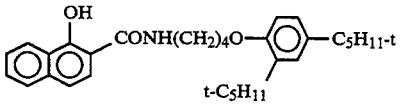

C6

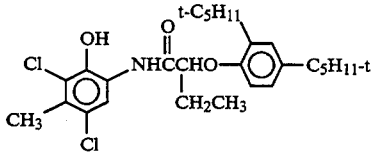

C7

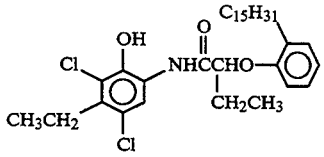

Other suitable cyan dye-forming couplers include structures C6–C26 disclosed on pages 9–12 of commonly assigned U.S. application Ser. No. 07/956,140 of Texter, filed Oct. 5, 1992, now U.S. Pat. No. 5,401,623, and are incorporated herein by reference.

M3

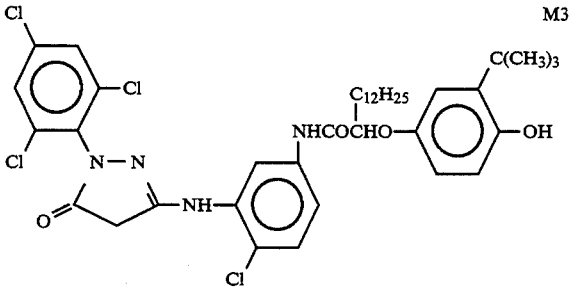

M4

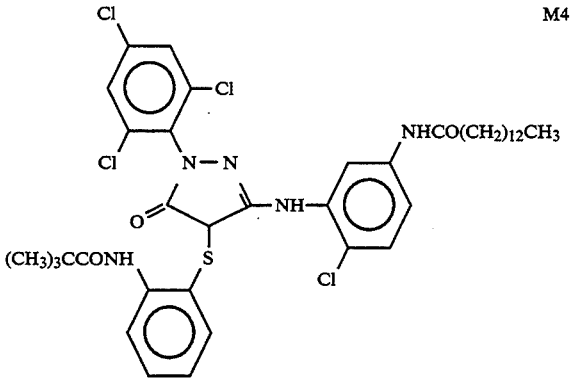

-continued

M5

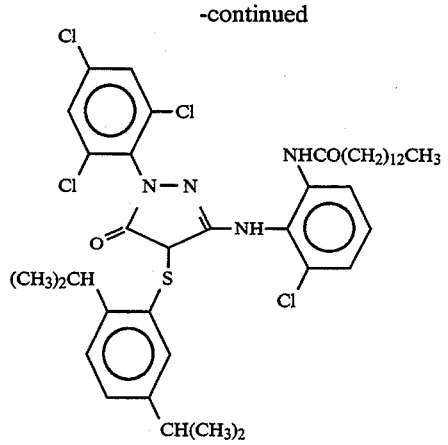

Other suitable magenta dye-forming couplers include structures M6–M43 disclosed on pages 13–20 of commonly assigned U.S. application Ser. No. 07/956,140 of Texter, filed Oct. 5, 1992, now U.S. Pat. No. 5,401,623, and are incorporated herein by reference.

Examples of suitable yellow dye-forming couplers include the following:

Y1

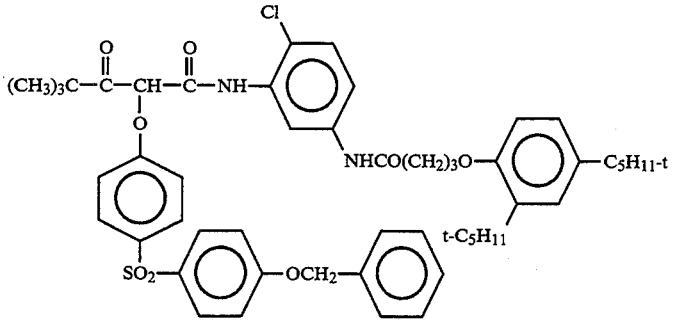

Y2

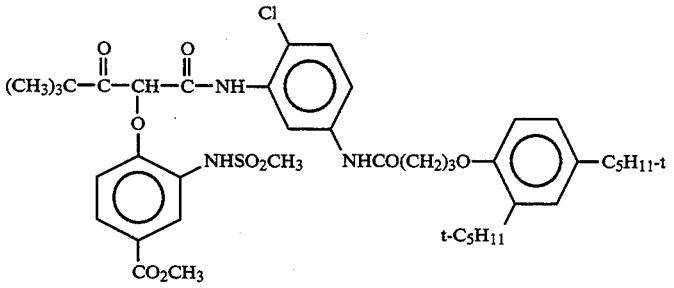

Other suitable yellow dye-forming couplers include structures Y3–Y26 disclosed on pages 21–25 of commonly assigned U.S. application Ser. No. 07/956,140 of Texter, filed Oct. 5, 1992, now U.S. Pat. No. 5,401,623, and are incorporated herein by reference.

Preferred couplers for the invention dispersions, photographic elements, and processes for forming dispersions include C1, C2, C3, C4, C5, M1, M2, M3,M4, M5, Y1, and Y2 because of their ready dispersability by roller-milling.

Dispersions of the present invention comprise couplers that react with the oxidized product of a primary amine developing agent. Said developing agents are preferably selected from the group comprising 4-amino-N,N-diethylaniline hydrochloride; 4-amino-3-methyl-N,N-diethyl aniline hydrochloride; 4-amino-3-methyl-N-ethyl-N-(β-methanesulfonamidoethyl)aniline sulfate hydrate; 4-amino-3-methyl-N-ethyl-N-(β-hydroxyethyl)aniline sulfate; 4-amino-3-(β-methane sulfonamido)ethyl-N,N-diethylaniline hydrochloride; 4-amino-3-methyl-N-ethyl-N-(β-methanesulfonamidoethyl)aniline sesquisulfate monohydrate; and 4-amino-3-methyl-N-ethyl-N-(2-methoxyethyl)aniline di-p-toluenesulfonic acid.

The invention colloidal dispersions of microcrystalline coupler can be obtained by any of the methods for imparting mechanical shear well known in the art, such as those methods described in U.S. Pat. Nos. 2,581,414 and 2,855,156 and in Canadian Patent No. 1,105,761, the disclosures of which are incorporated herein by reference. These methods include solid-particle milling methods such as ball-milling, pebble-milling, roller-milling, sand-milling, bead-milling, dyno-milling, Masap-milling, and media-milling. These methods further include colloid milling, milling in an attriter, dispersing with ultrasonic energy, and high speed agitation (as disclosed by Onishi et al. in U.S. Pat. No. 4,474,872 and incorporated herein by reference). Ball-milling, roller-milling, media-milling, and milling in an attriter are preferred milling methods because of their ease of operation, clean-up, and reproducibility.

Alternatively, coupler dispersions wherein said coupler is present in an amorphous physical state may be prepared by well known methods including colloid milling, homogenization, high speed stirring, sonication methods. The amorphous physical state of said coupler may then be transformed into a microcrystalline physical state by methods including thermal annealing and chemical annealing. Thermal annealing methods include temperature programmed thermal cycling to temperatures above any glass transition temperature of the amorphous coupler. Preferred thermal annealing comprises cycling said dispersion over the temperature range of 17° to 90 ° C. Said cycling may comprise any sequence of temperature changes that promotes microcrystalline phase formation from an extant amorphous physical state. Typically the duration of high temperature intervals are chosen to activate said phase formation while minimizing particle growth from ripening and collision processes. Chemical annealing methods include incubation with chemical agents that modify partitioning of couplers and surfactants between the continuous phase of said dispersion and the discontinuous phase. Such agents include hydrocarbons (such as hexadecane), surfactants, alcohols (such as butanol, pentanol, and undecanol), and high boiling organic solvents. Said agents may be added to the dispersion during or subsequent to particle formation. Said chemical annealing may include incubating said dispersion at 17° to 90° C. in the presence of said agent, stirring said dispersion in the presence of said agent, adding said agent and then removing it slowly by diafiltration methods.

The formation of colloidal dispersions in aqueous media usually requires the presence of dispersing aids such as surfactants, surface active polymers, and hydrophilic polymers. Such dispersing aids have been disclosed by Chari et al. in U.S. Pat. No. 5,008,179 (columns 13–14) and by Bagchi and Sargeant in U.S. Pat. No. 5,104,776 (see columns 7–13) and are incorporated herein by reference. Preferred dispersing aids include sodium dodecyl sulfate (DA-1), sodium dodecyl benzene sulfonate (DA-2), sodium bis(2-ethyl hexyl)sulfosuccinate (DA-3), Aerosol-22 (Cyanamid), sodium bis( 1-methyl pentyl)sulfosuccinate (DA-4), sodium bis(phenylethyl)sulfosuccinate (DA-5), sodium bis(β-phenyl ethyl)sulfosuccinate (DA-6), sodium bis(2-phenyl propyl)sulfosuccinate (DA-7), and the following:

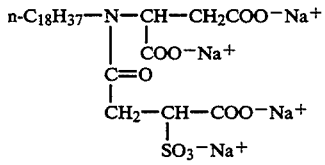
(DA-8)

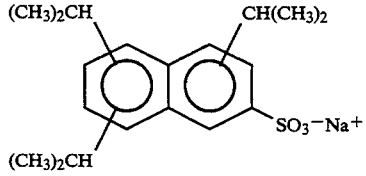
(DA-9)

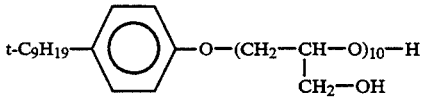
(DA-10)

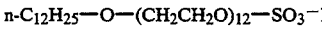
(DA-11)

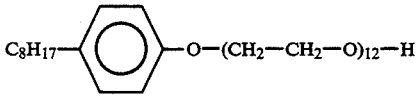
(DA-12)

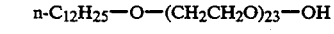
(DA-13)

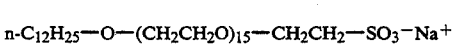
(DA-14)

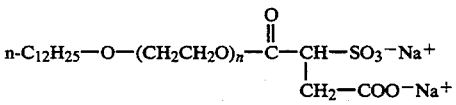
(DA-15)

-continued

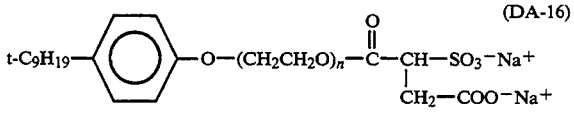
(DA-16)

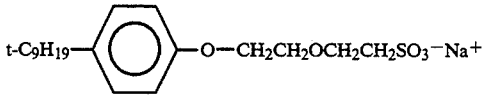
(DA-17)

Preferred hydrophilic polymers include gelatin, polyvinylalcohol, and polyvinylpyrollidone. Such dispersing aids are typically added at level of 1%–200% of dispersed coupler (by weight), and are typically added at preferred levels of 3%–30% of dispersed coupler (by weight).

Colloidal microcrystalline coupler particles less than 1 μm in largest dimension are preferably obtained because of their propensity to scatter less light than larger particles. More preferably because of higher surface to volume ratios, colloidal microcrystalline coupler particles less than 0.2 μm in largest dimension are obtained.

Permanent solvents suitable for use in the present invention may be any water immiscible organic solvent compatible with the microcrystalline couplers utilized. Such solvents have been disclosed, for example, by Bagchi in U.S. Pat. No. 4,970,139 and by Chari et al. in U.S. Pat. No. 5,008,179, the disclosures of which are incorporated herein by reference. Preferred permanent solvents include tri-cresyl phosphate (S1), di-n-butyl phthalate (S2), N,N-diethyl lauramide (S3), 2,4-di-t-amyl phenol (S4), 2,4-di-n-amyl phenol (S5), N-n-butyl acetanilide (S6), 1,4-cyclohexylene ethylhexanoate (S7), bis(2-ethylhexyl phthalate (S8), di-n-decyl phthalate (S9), bis( 10,11-epoxyundecyl) phthalate (S 10), tri-n-hexyl phosphate (S11), dimethyl phthalate (S12), 1-octanol (S13), 1-undecanol (S14), tri-cyclohexyl phosphate (S15), tri-isononyl phosphate (S16), tri-(2-ethylhexyl) phosphate (S17), p-dodecyl phenol (S18), N-n-amyl phthalimide (S19), bis(2-methoxyethyl) phthalate (S20), ethyl-N,N-di-n-butyl carbamate (S21), diethyl phthalate (S22), n-butyl-2-methoxybenzoate (S23), bis(2-n-butoxyethyl) phthalate (S24), diethyl benzylmalonate (S25), guaiacol acetate (S26), tri-m-cresyl phosphate (S26), ethyl phenylacetate (S27), phorone (S28), di-n-butyl sebacate (S29), di-n-octyl phthalate (S30), cresyl diphenyl phosphate (S31), butyl cyclohexyl phthalate (S32), tetrahydrofurfuryl adipate (S33), guaiacol n-caproate (S34), bis(tetrahydrofurfuryl)phthalate (S35), N,N,N',N'-tetraethyl phthalimide (S36), N-n-amyl succinimide (S37), and triethyl citrate (S38).

Permanent solvents can be prepared and initially incorporated into the microcrystalline coupler dispersion by any means well known in the art. Said solvents may initially be prepared as colloidal oil-in-water emulsions, as oil-in-aqueous gelatin emulsions, and as loaded latex dispersions. Such emulsions and loaded latexes may be prepared by well known methods. It is preferred, however, that such solvent incorporation into colloid .al dispersions of microcrystalline coupler be done simply and cheaply by pouring the desired amount of permanent solvent directly into the aqueous colloidal dispersion of coupler and agitating with standard means, said means comprising high speed stirring. Interfacial forces dictate the maximum amount of solvent that may be incorporated in this manner, before separate emulsion droplets become kinetically stabilized. The optimal amount of permanent solvent to be added to a given colloidal microcrystalline coupler dispersion will depend on the coupler, the particular crystalline state if polymorphs exist, the particular permanent solvent chosen, and the coupling activity desired in the particular photographic element. Methods of empirically determining such optima are well known to those skilled in the art. Such optima are, however, generally in the preferred coupler to permanent solvent weight ratio range of 1:0.02 to 1:4, and more preferably in the weight ratio range of 1:0.1 to 1:1 in order to minimize solvent loading while obtaining desired coupling activity.

In the following discussion of suitable materials for use in the emulsions and elements according to the invention, reference will be made to *Research Disclosure,* December 1989, Item 308119, published by Kenneth Mason Publications Ltd., Emsworth, Hampshire P010 7DQ, U.K., the disclosures of which are incorporated in their entireties herein by reference. This publication will be identified hereafter as "Research Disclosure".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in Research Disclosure Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide gains bounded by 100, 111, or 110 crystal planes.

The silver halide emulsions employed in the elements according to the invention can be either negative-working or positive-working. Suitable emulsions and their preparation are described in Research Disclosure Sections I and II and the publications cited therein.

Also useful are tabular gain silver halide emulsions. In general, tabular gain emulsions are those in which greater than 50 percent of the total gain projected area comprises tabular gain silver halide crystals having a gain diameter and thickness selected so that the diameter divided by the mathematical square of the thickness is greater than 25, wherein the diameter and thickness are both measured in microns. An example of tabular gain emulsions is described in U.S. Pat. No. 4,439,520. Suitable vehicles for the emulsion layers and other layers of elements according to the invention are described in Research Disclosure Section IX and the publications cited therein. The radiation-sensitive materials described above can be sensitized to a particular wavelength range of radiation, such as the red, blue, or green portions of the visible spectrum or to other wavelength ranges, such as ultraviolet infrared, X-ray, and the like. Sensitization of silver halide can be accomplished with chemical sensitizers such as gold compounds, iridium compounds, or other group VHI metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan colorforming coupler associated therewith. Color photographic elements and color-forming couplers are well-known in the art. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

Photographic elements according to the invention can be exposed to actinic radiation, typically in the visible region of the spectrum to form a latent image as described in Research Disclosure Section XVIII, and then processed to form a visible dye image as described in Research Disclosure Section XIX. Processing can be any type of known photographic processing, although it is preferably carded out at pH 9 to 14.

A negative image can be developed by using one or more of the aforementioned nucleophiles. A positive image can be developed by first developing with a nonchromogenic developer, then uniformly fogging the element, and then developing by a process employing one or more of the aforementioned nucleophiles.

Development is followed by the conventional steps of bleaching, fixing, or bleach-fixing, to remove silver and silver halide, washing, and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

EXAMPLES

Dispersion Preparation

Solid particle coupler dispersions were prepared by roller milling methods. Typically, a 250–500 mL glass jar containing the charge of coupler, water, dispersing aid, and zirconia (2-mm diameter) media was used; roller milling times of 3 to 5 days were used. The initial charge typically consisted of approximately 5–10 g coupler, 1–3 g dispersing aid, 50–100 g water, and 50–100 mL of zirconia beads. After shaking, 3–6 drops of Anti-foam A (Dow; 50 ppm aqueous suspension) were typically added. In most cases, about 5–10 g of 12.5% (w/w) aqueous gelatin was added to the charge. In certain cases a wetting agent such as isopropanol was also added to the charge. After milling, about 40–80 g of 12.5% aqueous gelatin was added to the jar, and the jar was placed back on the roller mill for a few minutes to achieve good mixing. The dispersion was then filtered to separate the zirconi a beads. In cases where permanent solvent was added to the dispersion, an appropriate weight of the permanent solvent was then mixed with an aliquot of the dispersion for about 5 minutes using a Polytron mixer. Dispersions without added permanent solvent were also subjected to about 5 minutes of mixing with a Polytron mixer.

Coating and Evaluation

Experimental coatings were prepared of each dispersion in a two-layer test format coated on transparent film support. The first layer typically contained about $2.14\times10^{-3}$ (couplers C1–C5, mol coupler/m$^2$, a polydisperse sulfur and gold sensitized silver bromoiodide emulsion at a level of about $1.1'10^{-2}$ mol/m$^2$ as silver, and about 3.76 g/m$^2$ of gelatin. A second layer containing about 1.07 g/m$^2$ of gelatin was coated over the first layer. Hardener (1,1'-[oxybis{methylene sulfonyl}]bisethene) was coated at a level corresponding to about 1.5% (w/w) of the total gelatin coated. After coating and chopping, the sensitized strips were exposed on a sensitometer to a tungsten light source though a 0 to 6 density 21-step tablet and processed at 100° F. in one of two developer solutions.

Developer solution A comprised:

| | |
|---|---|
| Anhydrous potassium carbonate | 37.5 g |
| Anhydrous sodium sulfate | 4.0 g |
| Potassium iodide | 1.2 mg |
| Sodium bromide | 1.3 g |
| 1,3-Diamino-2-propanoltetraacetic acid | 2.5 g |
| Hydroxylamine sulfate | 2.0 g |
| KODAK color developing agent CD-4 | 4.5 g |
| Water to make 1 liter | 10.00 ± 0.03 |
| pH @ 27° C. | |

Developer solution B comprised:

| | |
|---|---|
| Triethanolamine | 9.89 g |
| Phorwite REU (Mobay) | 0.80 g |
| Benzyl alcohol | 15.05 g |
| Hydroxylamine sulfate | 3.20 g |
| Lithium chloride | 1.68 g |

-continued

| | |
|---|---|
| Lithium polystyrenesulfonate (30% aqueous solution) | 0.20 g |
| KODAK color developing agent CD-3 | 5.20 g |
| Potassium sulfite (45% aqueous solution) | 4.19 g |
| 1-Hydroxyethyl-1,1-diphosphonic acid (60% aqueous solution) | 0.93 g |
| Anhydrous potassium carbonate | 29.62 g |
| Potassium bromide | 0.60 g |
| Potassium chloride | 0.50 g |
| Potassium hydroxide (45% aqueous solution) | 0.92 g |
| Water to make 1 liter | 10.00 ± 0.03. |
| pH @ 27° C. | |

After development for 1 minute, the strips were, with nitrogen burst agitation, immersed in a stop bath for 1 minute, rinsed in water for 3 minutes, immersed in an iron(HI) bleach solution for 3 minutes, rinsed in water for 3 minutes, immersed in a thiosulfate-based fixing solution for 3 minutes, rinsed in water for 3 minutes, and dried. Sensitometric curves were recorded through status-M filters.

EXAMPLES 1–6

Roller milled dispersions of coupler C1 were prepared by combining 10 g of C1, 2.5 g Aerosol-OT, about 110 g water, 10 g 12.5 % (w/w) aqueous gelatin 3.5 g isopropanol, 50 mL zirconia beads (about 1.8 mm in diameter), and about 6 drops of Anti-foam A. This mixture was milled for 5 days, and then about 70 g of melted 12.5% aqueous gelatin was added with mixing. The resulting dispersion was filtered, chill set, and stored in the cold until used.

Modified dispersions containing the permanent solvent di-n-butyl phthalate (S2) at C1:S2 weight ratios of 1:0.25 and 1:0.5 were prepared by adding an appropriate amount of S2 to the permanent solvent free dispersion and mixing in a Polytron stirrer for about 5 min. Electron micrographs of these dispersions showed platelike morphology with aspect ratios in the range of 20–60 and with effective circular diameters in the range of 1–4 $\mu$m.

Figure 2:
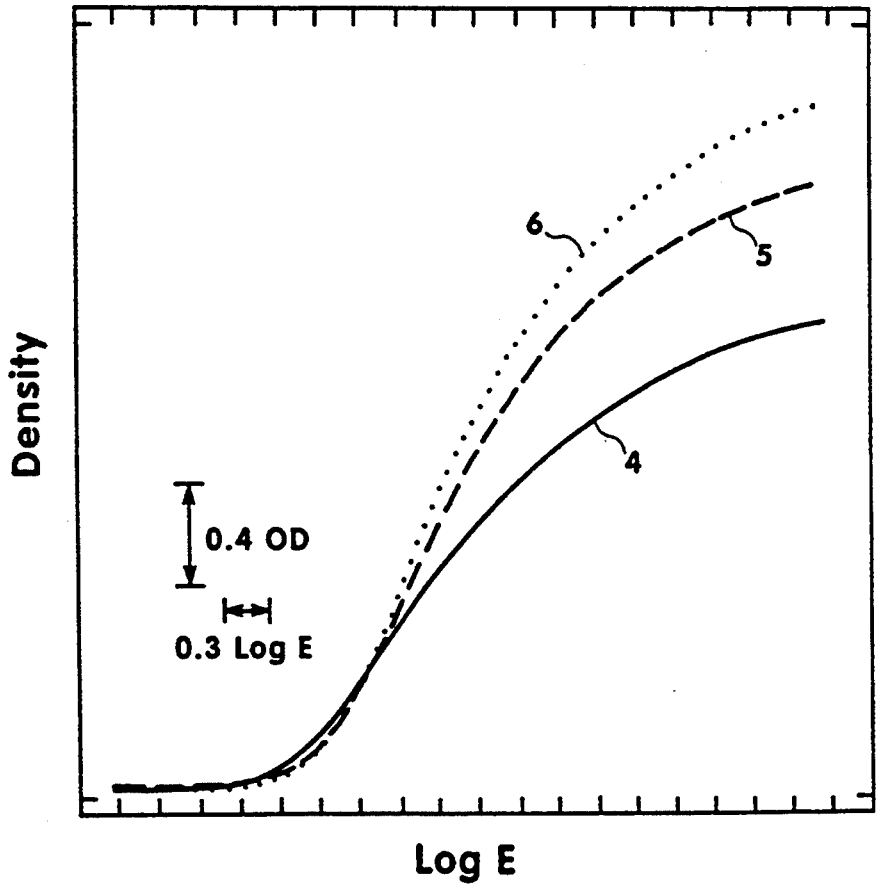
FIG. 2. Sensitometry for coatings of coupler C1, without (curve 4) and with S2 (1:0.25, curve 5; 1:0.5, curve 6), processed in developer B.

Sensitometry for test coatings of these dispersions after processing in developer A is illustrated in FIG. 1 for Examples 1–3 (curves 1–3, respectively) for the dispersion without added permanent solvent (curve 1), the dispersion 1:0.25 in C1:S2 ratio (curve 2), and the dispersion 1:0.5 in C1:S2 ratio (curve 3). These curves show that a large latitude in apparent dye-forming activity is available by varying the amount of added permanent solvent. Similar results, although highlighted in the upper scale, are illustrated in FIG. 2 for Examples 4–6 (curves 4–6, respectively) for these same test coatings processed in developer B, where the dispersion without added permanent solvent corresponds to curve 4, the dispersion 1:0.25 in C1:S2 ratio corresponds to curve 5, and the dispersion 1:0.5 in C1:S2 ratio corresponds to curve 6.

EXAMPLES 7–9

Three roller milled dispersions of Coupler C2 were prepared by combining.5 g of C2, 1 g Alkanol-XC, about 50 g water, 5 g melted 12.5% (w/w) aqueous gelatin, 100 mL zirconia beads, and about 4 drops of Anti-foam A in triplicate. These mixtures were milled for 3 days, filtered, and then combined into a single sample (155 g yield). About 102 g of melted 12.5% aqueous gelatin was added with mixing. The resulting dispersion was then chili set, and stored in the cold until used.

Figure 3:
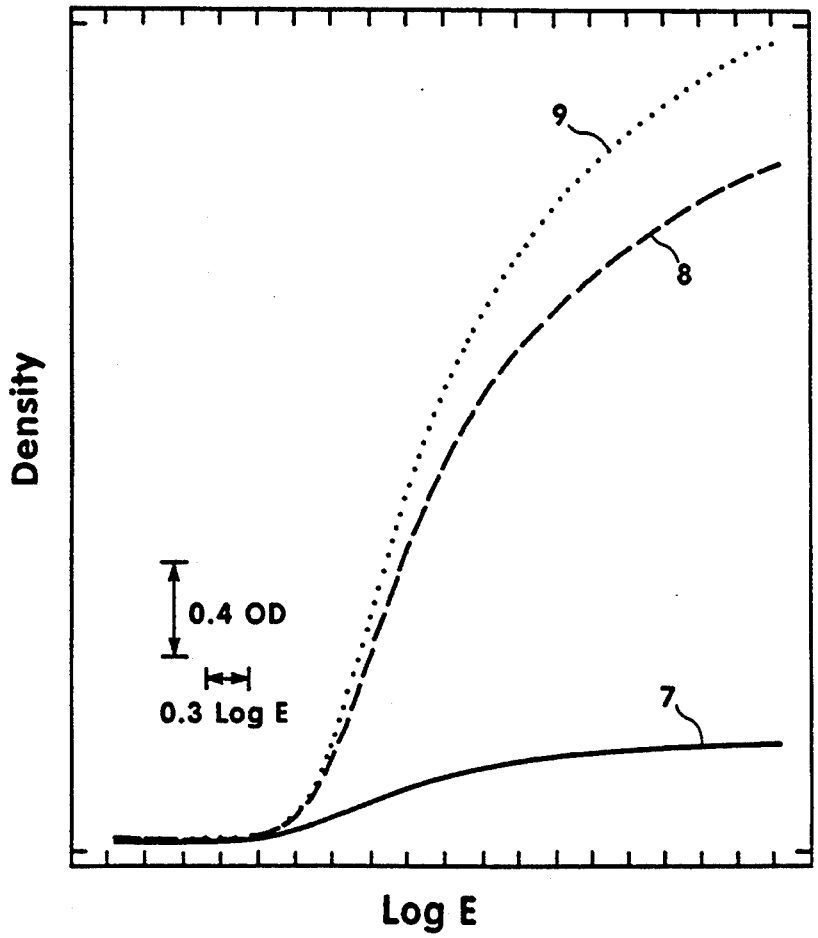
FIG. 3. Sensitometry for coatings of coupler C2, without (curve 7) and with S2 (1:0.25, curve 8; 1:0.5, curve 9), processed in developer A.

Modified dispersions containing the permanent solvent di-n-butyl phthalate (S2) at C2:S2 weight ratios of 1:0.5 and 1:1 were prepared by adding an appropriate amount of S2 to the permanent solvent-free dispersion and mixing in a Polytron stirrer for about 5 min. Electron micrographs of these dispersions showed polydisperse platelike morphology. Dispersions with added S2 showed no significant morphological dissimilarity to the dispersion prepared without added S2. Sensitometry for test coatings of these dispersions after processing in developer A is illustrated in FIG. 3 for Examples 7–9 (curves 7–9, respectively) for the dispersion without added permanent solvent (curve 7), the dispersion 1:0.5 in C2:S2 ratio (curve and the dispersion 1:1 in C2:S2 ratio (curve 9). These curves also show that a large latitude in apparent dye-forming activity is available by varying the amount of added permanent solvent.

EXAMPLES 10–15

Roller milled dispersions of coupler C3 were prepared by combining about 10 g of C3,2.5 g Aerosol-OT, about 110g water, 10 g of melted 12.5% (w/w) aqueous gelatin, 3.5 g isopropanol, 50 mL zirconia beads, and about 6 drops of Anti-foam A. This mixture was milled for 5 days, and then about 70 g of melted 12.5% aqueous gelatin was added with mixing. The resulting dispersion was filtered, chill set, and stored in the cold until used.

Modified dispersions containing the permanent solvent di-n-butyl phthalate (S2) at C3:S2 weight ratios of 1:0.25 and 1:0.5 were prepared by adding an appropriate amount of S2 to aliquots of the permanent solvent free dispersion and mixing in a Polytron stirrer for about 5 min. Electron micrographs of these dispersions showed that three-dimensional parallelepiped morphology predominates for this method of preparation. Microcrystalline particle sizes were polydisperse, and in the range of approximately 0.1–1 μm.

Figure 4:
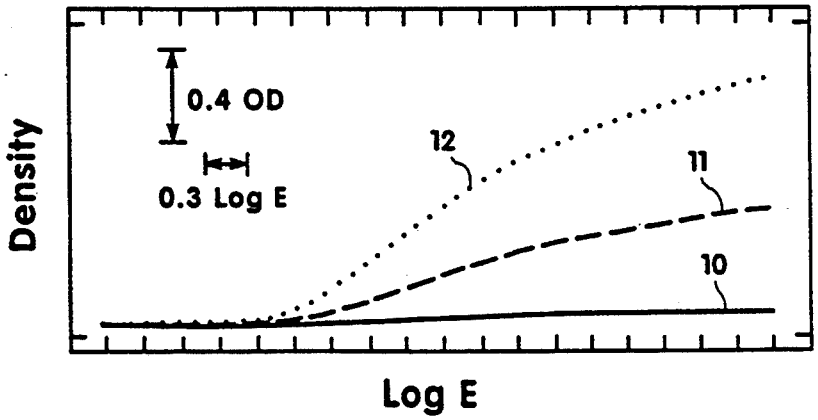
FIG. 4. Sensitometry for coatings of coupler C3, without (curve 10) and with S2 (1:0.25, curve 11; 1:0.5, curve 12), processed in developer A.
Figure 5:
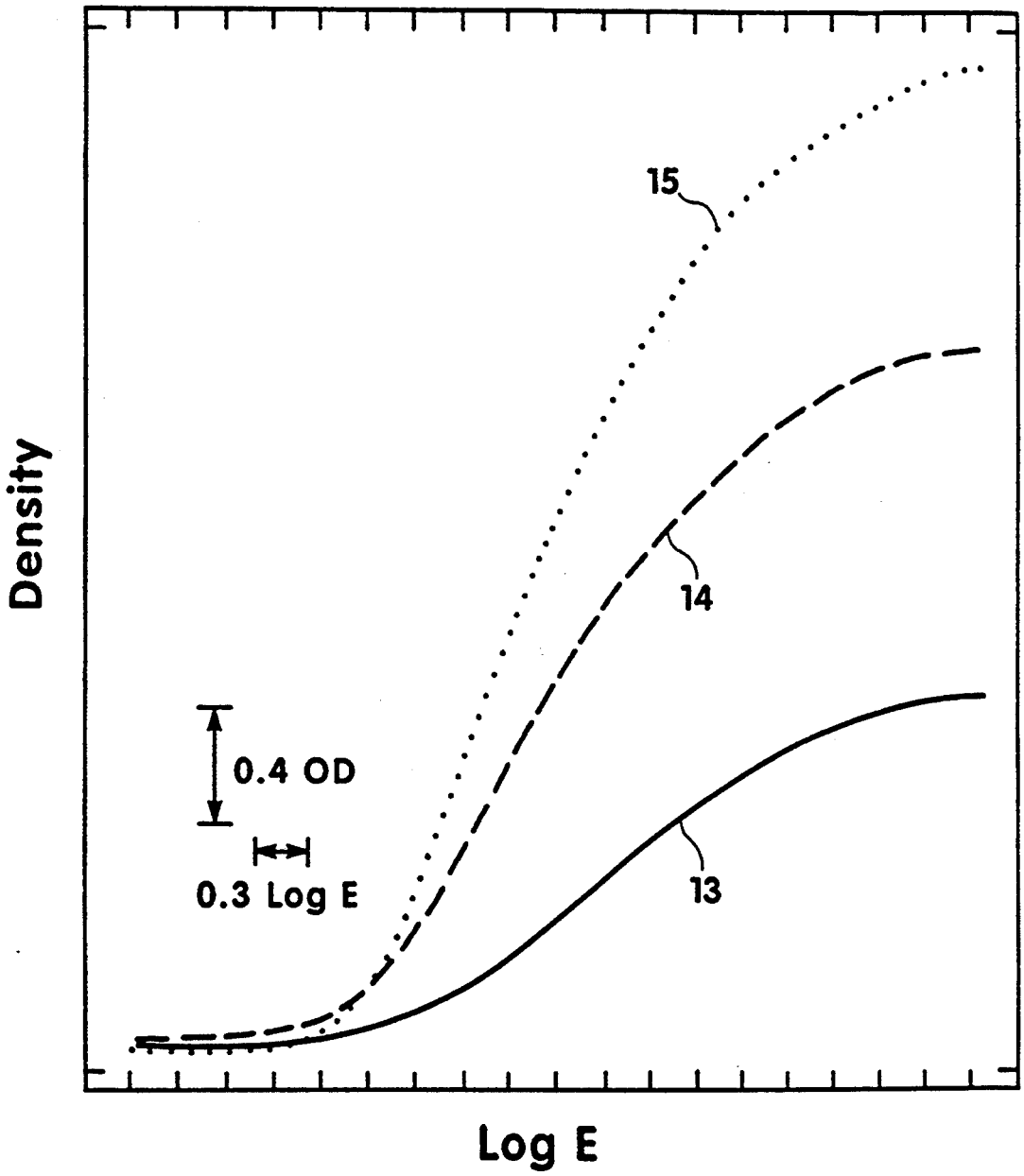
FIG. 5. Sensitometry for coatings of coupler C3, without (curve 13) and with S2 (1:0.25, curve 14; 1:0.5, curve 15), processed in developer B.

Sensitometry for test coatings of these dispersions after processing in developer A is illustrated in FIG. 4 for Examples 10–12 (curves 10–12, respectively) for the dispersion without added permanent solvent (curve 10), the dispersion 1:0.25 in C3:S2 ratio (curve 11 ), and the dispersion 1:0.5 in C3:S2 ratio (curve 12). These curves again show that a large latitude in apparent dye-forming activity is available by varying the amount of added permanent solvent. Similar results are illustrated in FIG. 5 or Examples 13–16 (curves 13–15, respectively) for these same test coatings processed in developer B, where the dispersion without added permanent solvent corresponds to curve 13, the dispersion 1:0.25 in C3:S2 ratio corresponds to curve 14, and the dispersion 1:0.5 in C3:S2 ratio corresponds to curve 15.

EXAMPLES 16–18

Roller milled dispersions of coupler C4 were prepared by combining about 10 g of C4, 10 g 10% aqueous Olin-10G, 10 g 6.8% aqueous TX-200, about 208 g water, 20 g isopropanol, and about 130 mL zirconia beads. This mixture was milled for 5 days, and then about 80 g of melted 12.5% aqueous gelatin was added with mixing. The resulting dispersion was filtered, chill set, and stored in the cold until used.

Modified dispersions containing the permanent solvent di-n-butyl phthalate (S2) at C4:S2 weight ratios of 1:0.5 and 1:1 were prepared by adding an appropriate amount of S2 to aliquots of the permanent solvent free dispersion and mixing in a Polytron stirrer for about 5 min. Electron micrographs of these dispersions showed that rectangular plates predominated in the particle morphology and that the larger particles exhibited aspect ratios on the order of 10. Particle sizes were polydisperse, and many of the particles were greater than 2 gm in length, with widths running about 20–25% of the lengths. The average equivalent circular diameter was about 0.5 μm.

Figure 6:
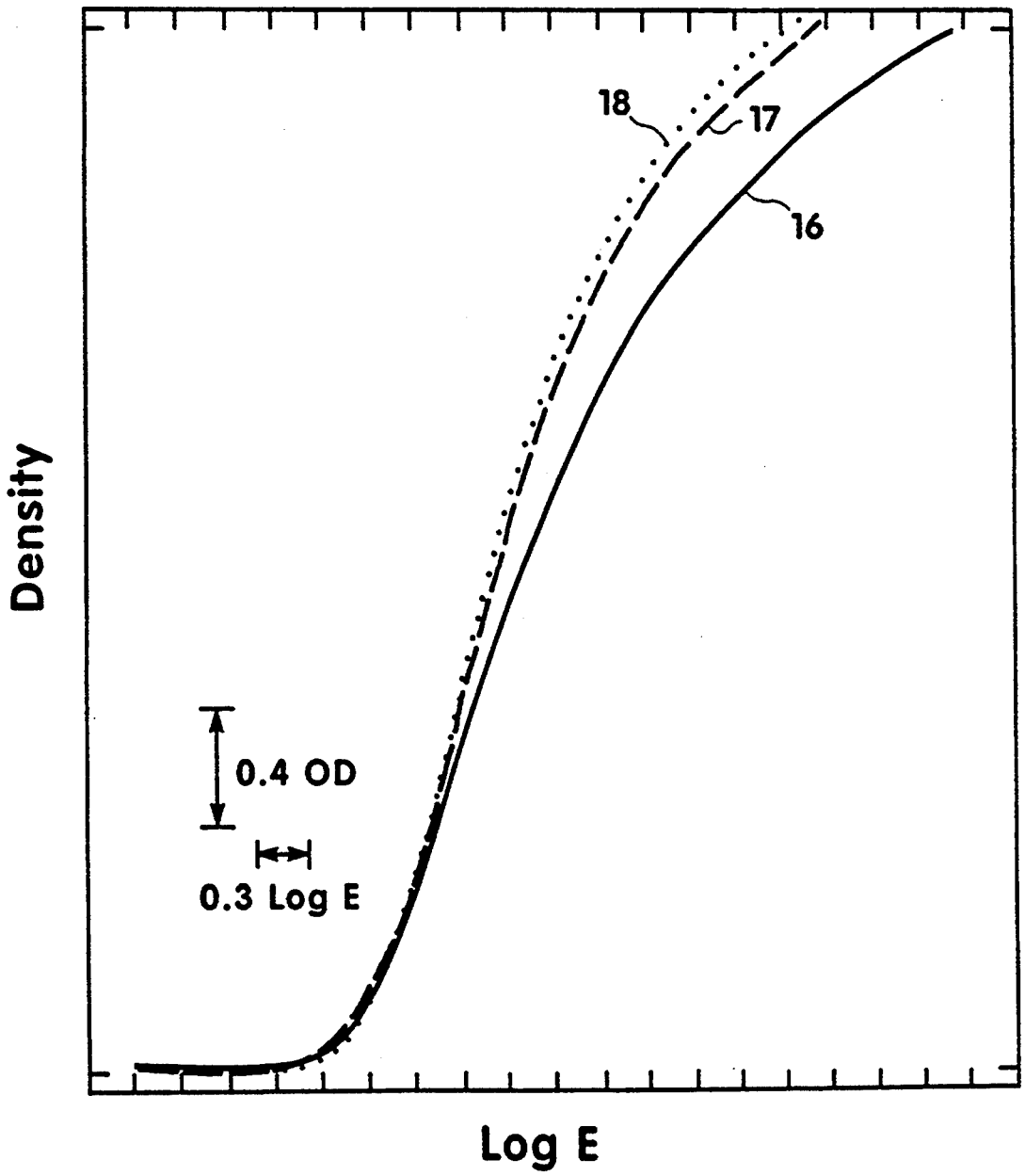
FIG. 6. Sensitometry for coatings of coupler C4, without (curve 16) and with S2 (1:0.5, curve 17; 1:1, curve 18), processed in developer A.

Sensitometry for test coatings of these dispersions after processing in developer A is illustrated in FIG. 6 for Examples 16–18 (curves 16–18, respectively) for the dispersion without added permanent solvent (curve 16), the dispersion 1:0.5 in C4:S2 ratio (curve 17), and the dispersion 1:1 in C4:S2 ratio (curve 18). The effects of added permanent solvent are particularly evident in the upper scale.

EXAMPLES 19–24

Roller milled dispersions of coupler C5 were prepared by combining about 25 g of C5, about 6.3 g of Aerosol-OT, about 250 g water, about 25 g melted 12.5% aqueous gelatin, and about 500 mL zirconia beads. This mixture was milled for 5 days, warmed to about 40° C., and then about 175 g of melted 12.5% aqueous gelatin was added with mixing. The resulting dispersion was filtered, chill set, and stored in the cold until used.

Modified dispersions containing the permanent solvent di-n-butyl phthalate (S2) at C5:S2 weight ratios of 1:0.25 and 1:0.5 were prepared by adding an appropriate amount of S2 to aliquots of the permanent solvent free dispersion and mixing in a Polytron stirrer for about 5 min. Electron micrographs of these dispersions showed that the predominant particle morphology was platelike, and that the morphology in the dispersions with added S2 was identical to that without.

Figure 7:
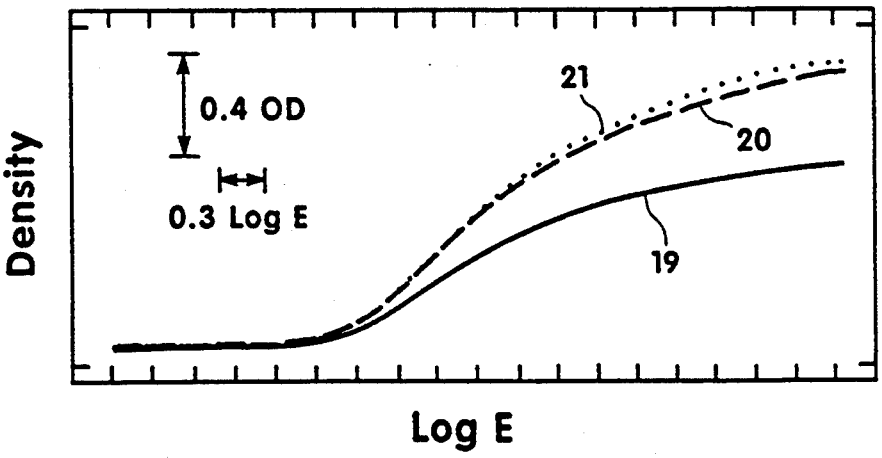
FIG. 7. Sensitometry for coatings of coupler C5, without (curve 19) and with S2 ( 1:0.25, curve 20; 1:0.5, curve 21 ), processed in developer A.
Figure 8:
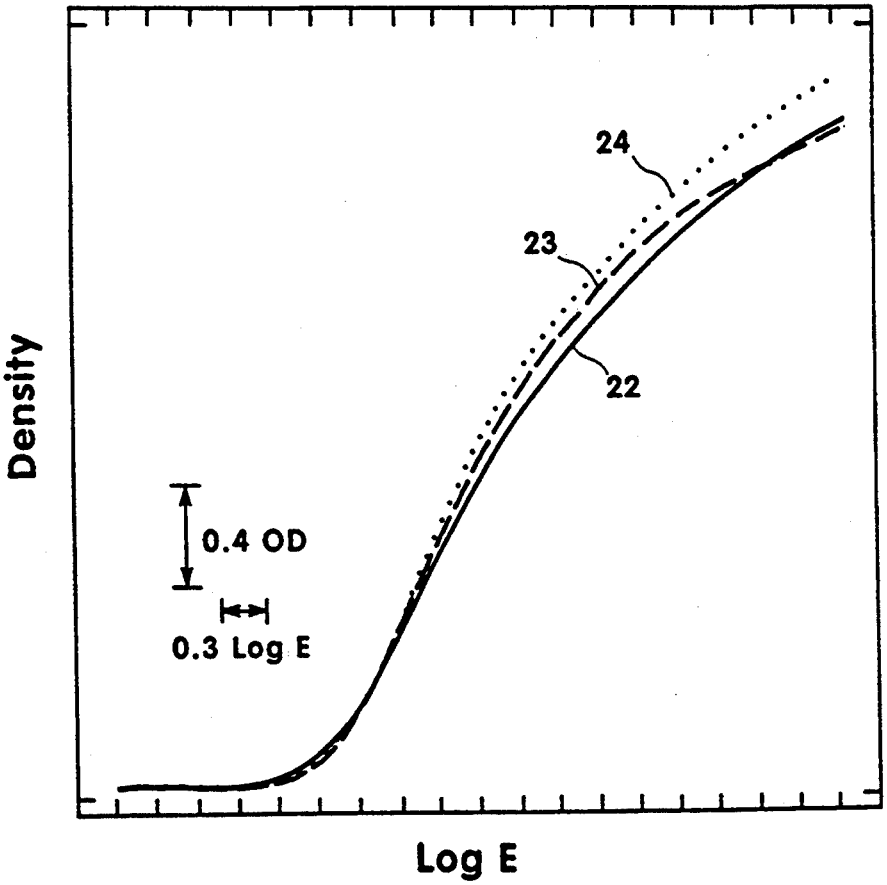
FIG. 8. Sensitometry for coatings of coupler C5, without (curve 22) and with S2 (1:0.25, curve 23; 1:0.5, curve 24), processed in developer B.
Figure 9:
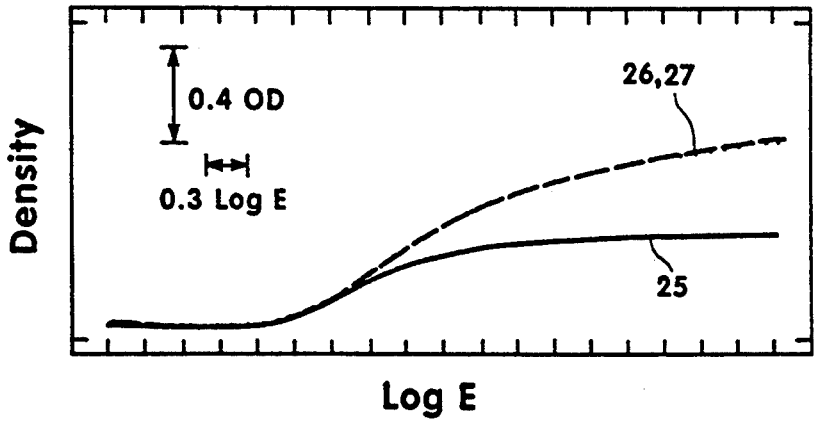
Figure 10:
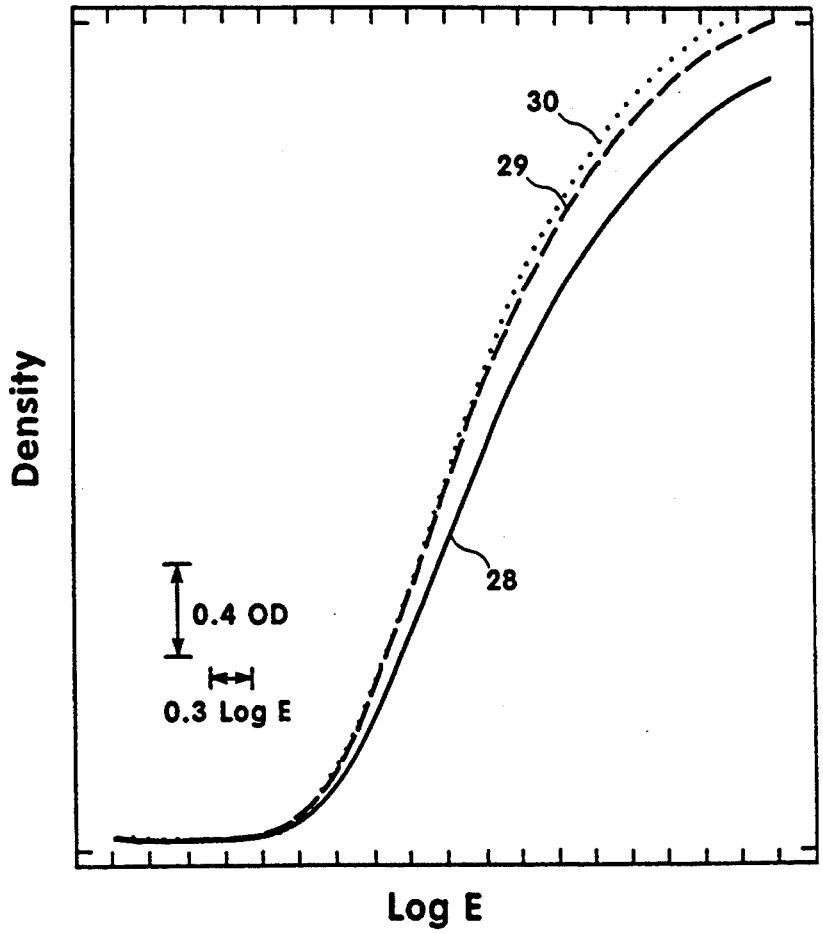
Figure 11:
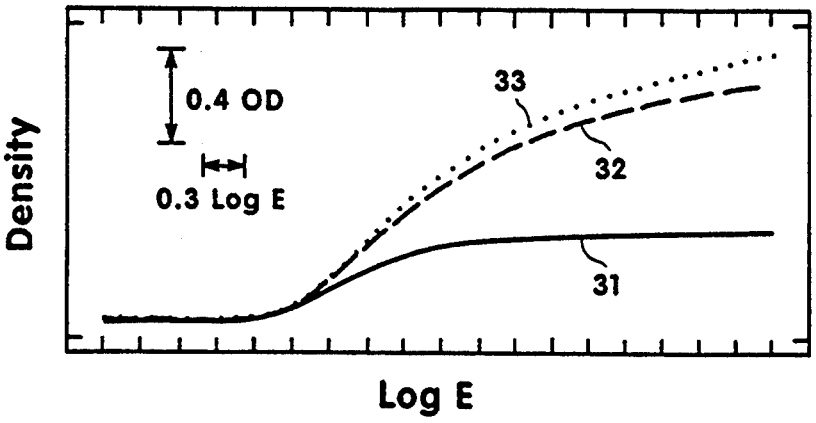
Figure 12:
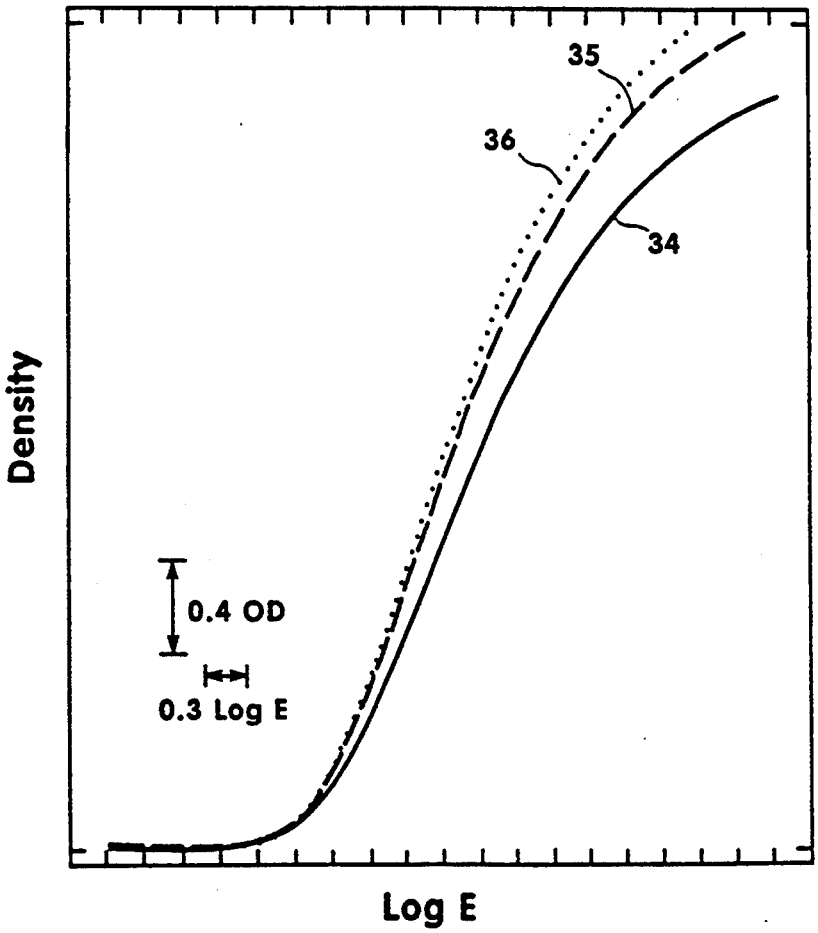
Figure 13:
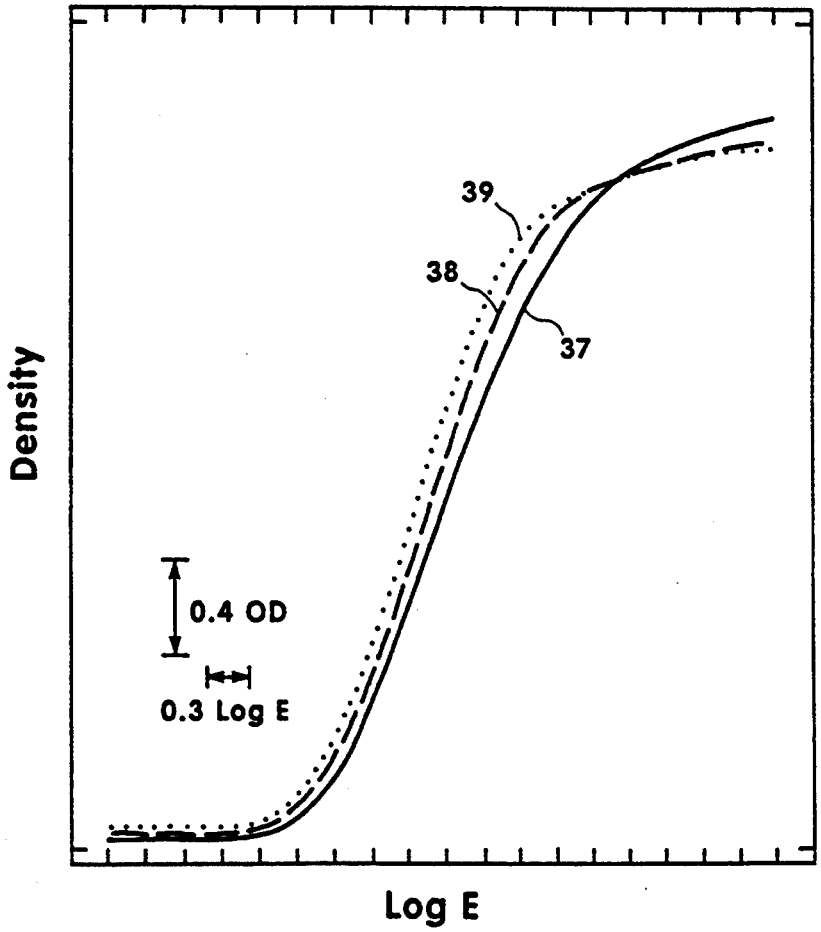
Figure 14:
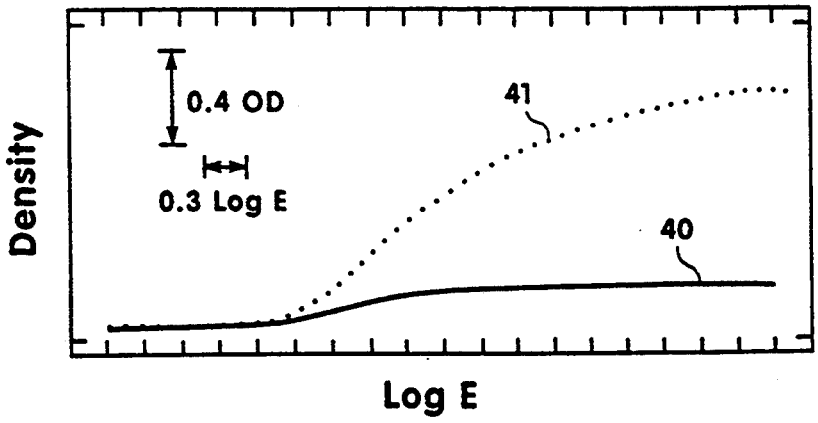
Figure 15:
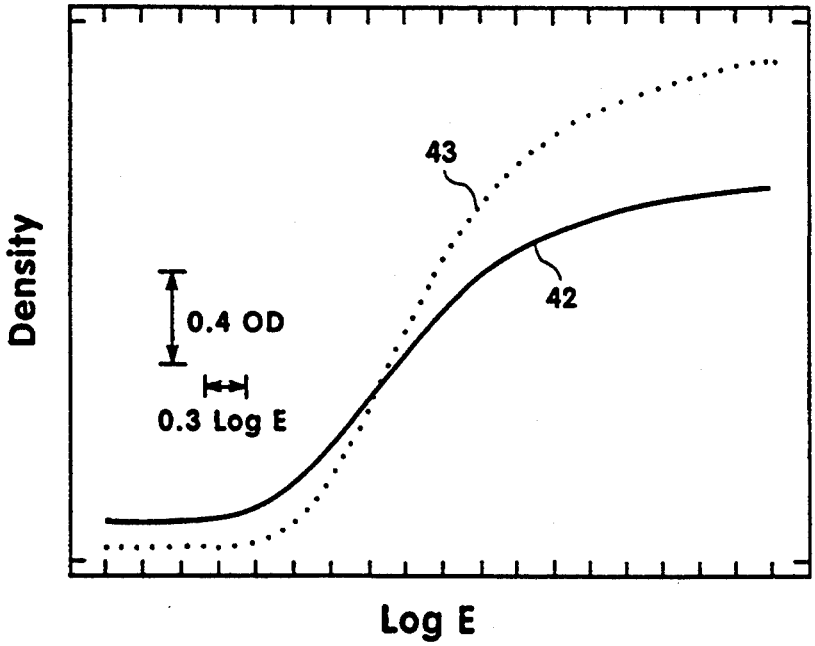
Figure 16:
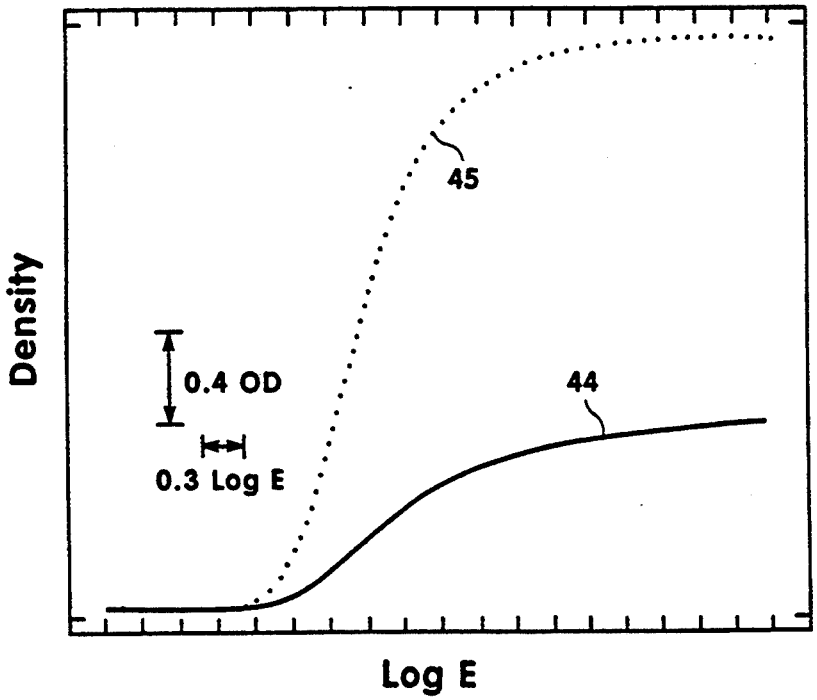
Figure 17:
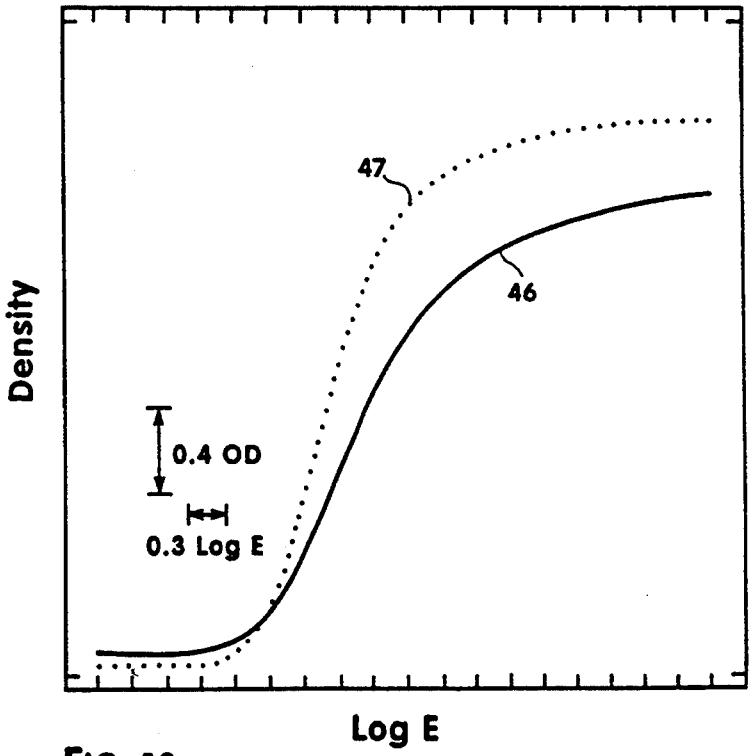
Figure 18:
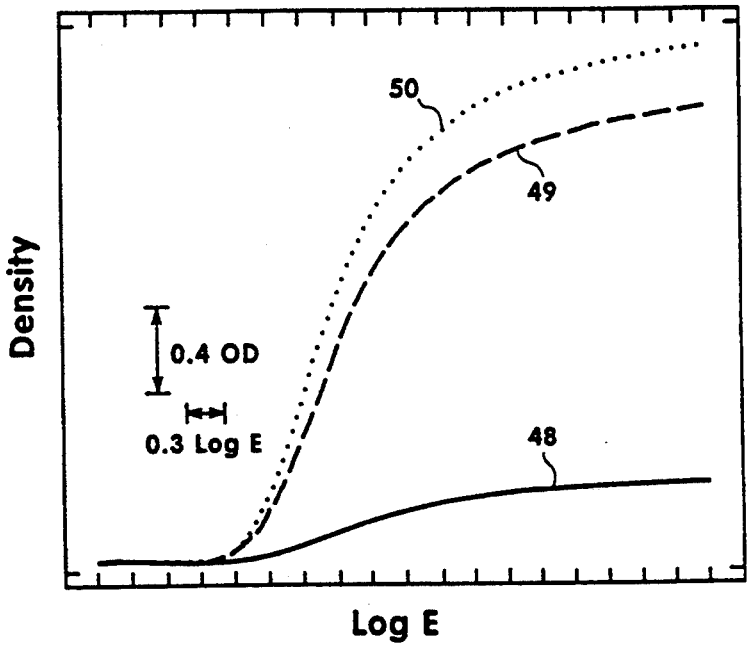
Figure 19:
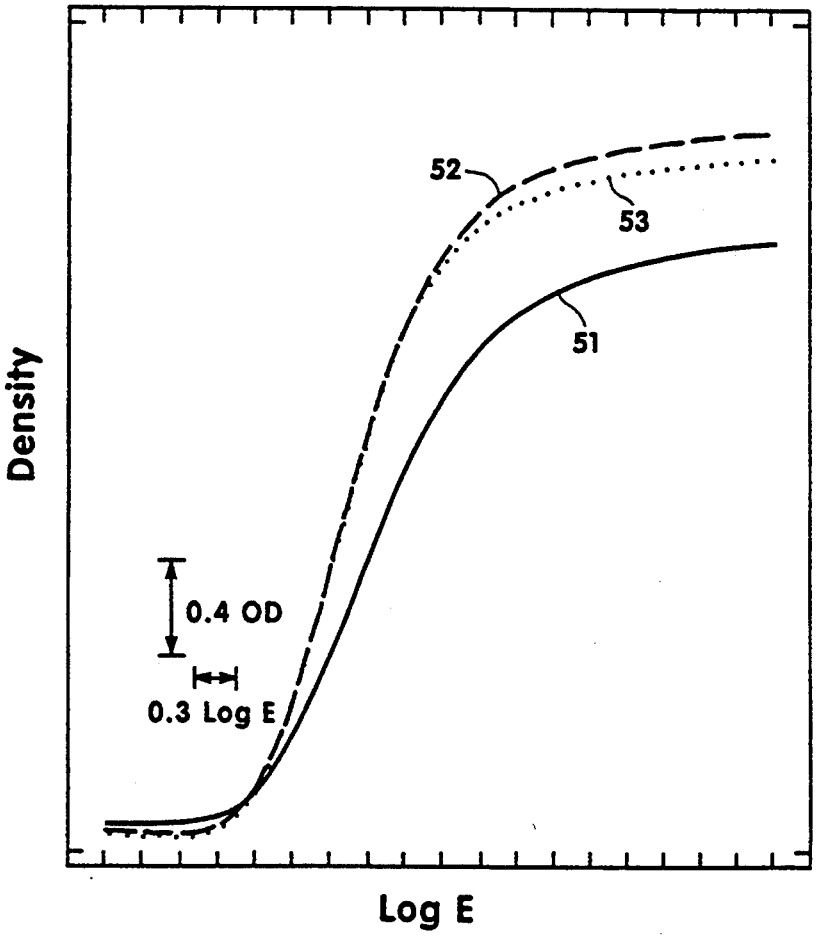
Figure 20:
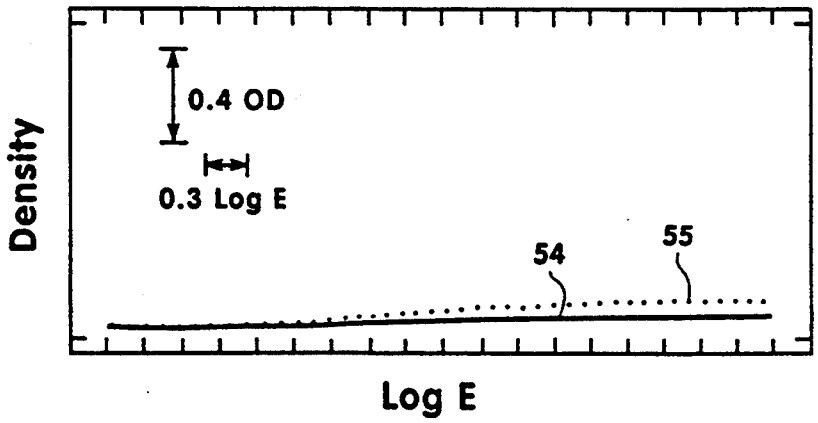
Figure 21:
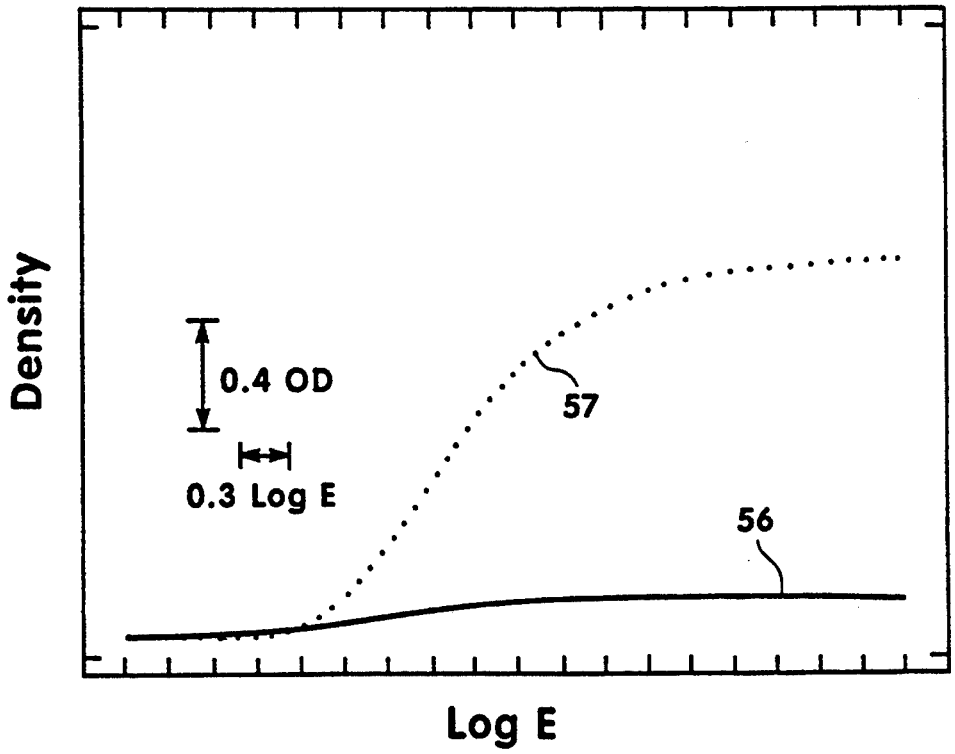

Sensitometry for test coatings of these dispersions after processing in developer A is illustrated in FIG. 7 for Examples 19–21 (curves 19–21, respectively) for the dispersion without added permanent solvent (curve 19), the dispersion 1:0.25 in C5:S2 ratio (curve 20), and the dispersion 1:0.5 in C5:S2 ratio (curve 21). The effects of added permanent solvent are evident throughout the illustrated scale. Similar results are illustrated in FIG. 8 for Examples 22–24 (curves 22–24, respectively) for these same test coatings processed in developer B, where the dispersion without added permanent solvent corresponds to curve 22, the dispersion 1:0.25 in C5:S2 ratio corresponds to curve 23, and the dispersion 1:0.5 in C5:S2 ratio corresponds to curve 24. Here the effects of added permanent solvent are most evident in the upper scale.

Additional examples of the processes of the present invention are illustrated in FIGS. 9–23 and in Examples 25–63 on page 36, line 11, through page 41, line 18, of commonly assigned U.S. application Ser. No. 07/956,140 of Texter, filed Oct. 5, 1992, now U.S. Pat. No. 5,401,623, are incorporated herein by reference.

Modified dispersions containing the permanent solvent di-n-butyl phthalate (S2) at Y2:S2 weight ratios of 1:0.25 and 1:0.5 were prepared by adding an appropriate amount of S2 to the permanent solvent-free dispersion and mixing in a Polytron stirrer for about 5 min. Electron micrographs of the dispersion without added permanent solvent showed that the largest population of particles was about 0.1 μm or less in equivalent spherical diameter. There also was a population of larger plates with rough surfaces of 0.2–0.6 μm in equivalent circular diameter. The addition of S2 apparently facilitated ripening of these particles. Surfaces appeared smoother and an intermediate sized population of plates (0.2 μm equivalent circular diameter) was present.

Figure 22:
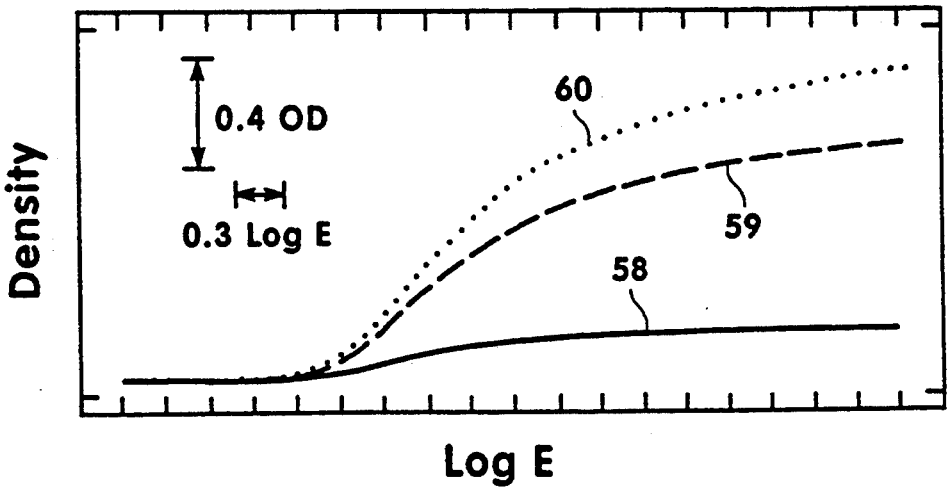
Figure 23:
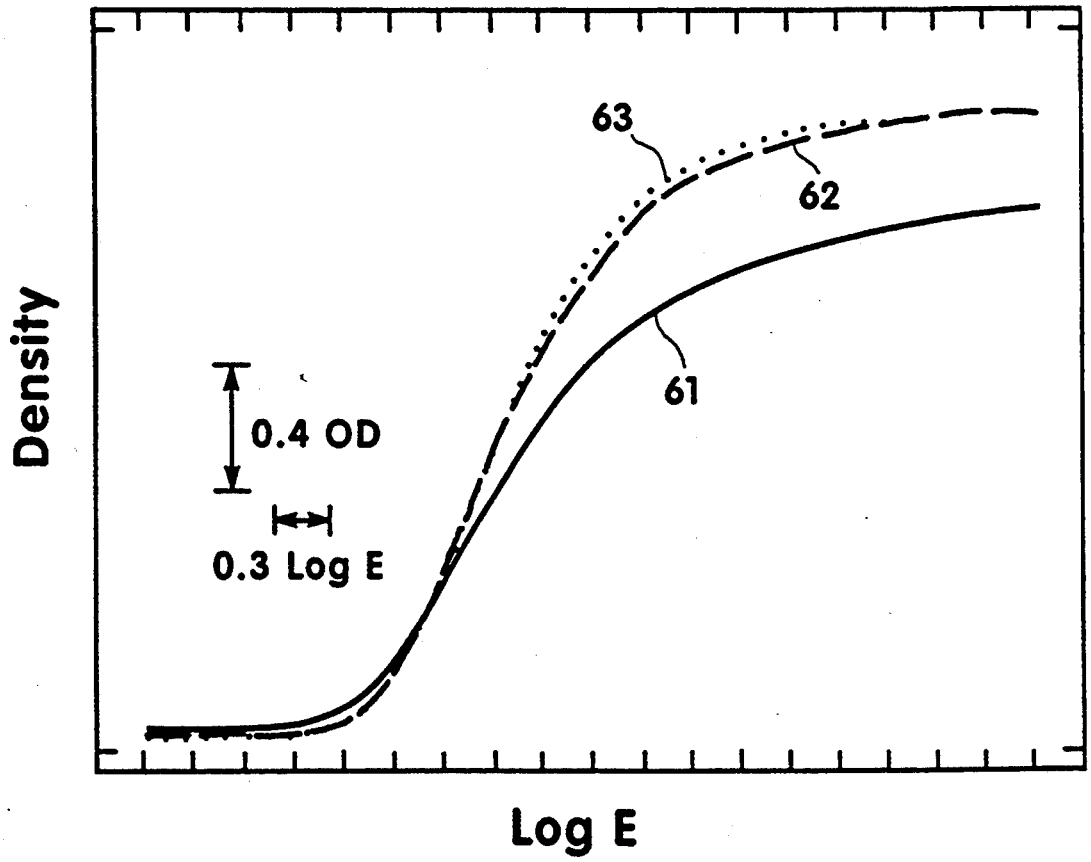

Sensitometry for test coatings of these dispersions after processing in developer A is illustrated in FIG. 22 for Examples 58–60 (curves 58–60, respectively) for the dispersion without added permanent solvent (curve 58), the dispersion 1:0.25 in Y2:S2 ratio (curve 59), and the dispersion 1:0.5 in Y2:S2 ratio (curve60). These curves also show that added S2 dramatically increases coupling activity. Similar results are illustrated in FIG. 23 for Examples 61–63 (curves 61–63, respectively) for these same test coatings processed in developer B, where the dispersion without added permanent solvent corresponds to curve 61, the dispersion 1:0.25 in Y2:S2 ratio corresponds to curve 62, and the dispersion 1:0.5 in Y2:S2 ratio corresponds to curve 63.

The invention has been described in detail with particular reference to preferred embodiments thereof, but it will be understood that variations and modifications can be effected within the spirit and scope of the invention.

What is claimed is:

1. A process for forming a microcrystalline coupler dispersion comprising the steps of: providing crystalline coupler in an aqueous suspension; dispersing said coupler with mechanical shear to form it coupler dispersion; combining said coupler dispersion with an activating water-immiscible organic solvent to form a combined dispersion; and mixing said combined dispersion.

2. A process as in claim 1 wherein said crystalline coupler in an aqueous suspension is derived from an amorphous aqueous coupler dispersion by thermal annealing.

3. A process as in claim 1 wherein said crystalline coupler in an aqueous suspension is derived from an amorphous aqueous coupler dispersion by chemical annealing.

4. A process as in claim 3 wherein said chemical annealing comprises incubating said dispersion with a chemical agent that modifies the partitioning of said coupler between the continuous and discontinuous phases of said amorphous aqueous coupler dispersion.

5. A process as in claim 1 wherein said mechanical shear is provided by milling methods selected from the group consisting of ball-milling, pebble-milling, roller-milling, sand-milling, bead-milling, dyno-milling, Masap-milling, media-milling, colloid milling, milling in an attriter, dispersing with ultrasonic energy, and high speed agitation.

6. A process as in claim 5, wherein said mechanical shear is provided by media milling.

7. A process as in claim 1, wherein dispersing aids are added during said dispersing step or are present in said suspension when providing said crystalline coupler in an aqueous suspension.

8. A process as in claim 7 wherein said dispersing aids are selected from the group consisting essentially of sodium dodecyl sulfate, sodium dodecyl benzene sulfonate, sodium bis(2-ethyl hexyl)sulfosuccinate), sodium bis( 1-methyl pentyl)sulfosuccinate, sodium bis(-phenylethyl)sulfosuccinate, sodium bis(p-phenyl ethyl)-sulfosuccinate, sodium bis(2-phenyl propyl)sulfosuccinate,

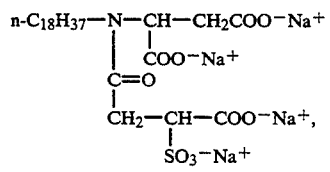

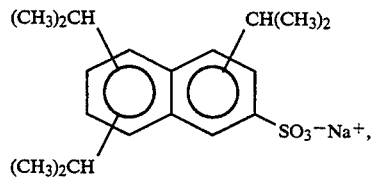

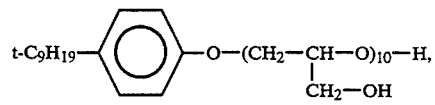

$n\text{-}C_{12}H_{25}—O—(CH_2CH_2O)_{12}—SO_3^-Na^+$,

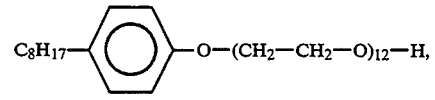

$n\text{-}C_{12}H_{25}—O—(CH_2CH_2O)_{23}—OH$, $n\text{-}C_{12}H_{25}—O—(CH_2CH_2O)_{15}—CH_2CH_2—SO_3^-Na^+$,

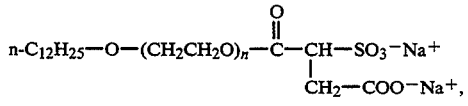

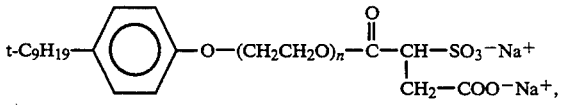

and

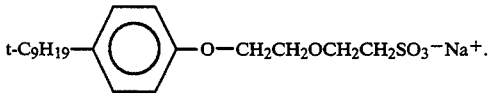

9. A process as in claim 7, wherein said dispersing aids are selected from the group consisting essentially of gelatin, polyvinylalcohol, and polyvinylpyrrolidone.

10. A process as in claim, 7, wherein said dispersing aids are added at a level of 3–30% by weight of said coupler.

11. A process as in claim 1 wherein said solvent is provided in the form of a loaded latex dispersion.

12. A process as in claim 1 wherein said solvent is provided in the form of an oil-in-water emulsion.

13. A process as in claim 1, wherein said solvent is selected from the group consisting essentially of tri-cresyl phosphate, di-n-butyl phthalate, N,N-diethyl lauramide, 2,4-di-t-amyl phenol, 2,4-di-n-amyl phenol, N-n-butyl acetanilide, 1,4-cyclohexylene ethylhexanoate, bis(2-ethylhexyl phthalate, di-n-decyl phthalate, bis(10,11-epoxyundecyl) phthalate, tri-n-hexyl phosphate, dimethyl phthalate, 1-octanol, 1-undecanol, tricyclohexyl phosphate, tri-isononyl phosphate, tri-92-ethylhexyl) phosphate, p-dodecyl phenol, N-n-amyl phthalimide, bis(2-methoxyethyl) phthalate, ethyl-N,N-di-n-butyl carbamate, diethyl phthalate, n-butyl-2-methoxybenzoate, bis(2-n-butoxyethyl) phthalate, diethyl benzylmalonate, guaiacol acetate, tri-m-cresyl phosphate, ethyl phenylacetate, phorone, di-n-butyl sebacate, di-n-octyl phthalate, cresyl diphenyl phosphate, butyl cyclohexyl phthalate, tetrahydrofurfuryl adipate, guaiacol n-caproate, bis(tetrahydrofurfuryl)phthalate, N,N,N',N'-tetraethyl phthalimide, N-n-amyl succinimide, and triethyl citrate.

14. A process as in claim 1, wherein said combining is done by pouring said solvent into the dispersion obtained from said dispersing step, and wherein said mixing comprises high speed stirring.

15. A process as in claim 1, wherein said solvent is added at a solvent to coupler weight ratio of 0.02:1 to 1:1.

16. A process as in claim 1, wherein said coupler contains a carboxyl or sulfonamido group.

17. A process for forming a microcrystalline coupler dispersion comprising the steps of:

providing crystalline coupler in an aqueous suspension;

adding a dispersing aid to said suspension at 1–30% by weight of said coupler; dispersing said coupler to form a coupler dispersion by a milling method selected from the group consisting essentially of ball-milling, roller-milling, milling in an attriter, bead milling, media milling, and high shear agitation;

combining said coupler dispersion with an activating water-immiscible organic solvent to form it combined dispersion, where said solvent is added at a solvent to coupler weight ratio of 0.02:1 to 1:1; and mixing said combined dispersion.

18. A process as in claim 17, wherein said coupler contains a carboxyl or sulfonamido group.

* * * * *